US005280738A

United States Patent [19]

Liou

[11] Patent Number: 5,280,738

[45] Date of Patent: Jan. 25, 1994

[54] HAMMER WITH AN ANGLE-ADJUSTABLE HEAD

[76] Inventor: Mou-Tang Liou, No. 33, Hsi-Hu Rd., Ta-Li Hsiang, Taichung Hsien, Taiwan

[21] Appl. No.: 89,618

[22] Filed: Jul. 12, 1993

Related U.S. Application Data

[63] Continuation of Ser. No. 974,671, Nov. 12, 1992, abandoned, which is a continuation of Ser. No. 747,612, Aug. 20, 1991, abandoned.

[51] Int. Cl.[5] ..... B25D 1/00

[52] U.S. Cl. ..... 81/20; 81/177.8; 81/177.9

[58] Field of Search ..... 81/20, 25, 26, 177.7, 81/177.8, 177.9, 489

[56] References Cited

U.S. PATENT DOCUMENTS

| | | | |
|---|---|---|---|
| 879,525 | 2/1908 | Cook | 81/177.8 |
| 1,822,280 | 9/1931 | Ervay | 81/20 X |
| 2,933,963 | 4/1960 | Blasdell | 81/177.8 X |

*Primary Examiner*—D. S. Meislin

*Attorney, Agent, or Firm*—Johnson & Gibbs

[57] ABSTRACT

A hammer includes a handle having a head pivotally connected to one end of the handle. A positioning device is provided to position the head at an angle with respect to the handle.

2 Claims, 9 Drawing Sheets

HAMMER WITH AN ANGLE-ADJUSTABLE HEAD

This is a continuation of application Ser. No. 07,974,671, filed Nov. 12, 1992, now abandoned, which is a continuation of application Ser. No. 07/747,612, filed Aug. 20, 1991, now abandoned.

BACKGROUND OF THE INVENTION

1. Field of the Invention

This invention relates to a hammer, more particularly to a hammer having a head which can be rotated with respect to the handle of said hammer and positioned by a positioning means.

2. Description of the Related Art

Referring to FIG. 1, a conventional hammer includes a handle 1 and a head 2 fixed to one end of the handle 1. The head 2 includes a bell portion (*2a*) and a claw portion (*2b*). Such a hammer may be inconvenient for a user to pull or strike a nail out of an object 90 when the handle 1 and/or head 2 are hindered by an obstacle 100 in the operation room because the head 2 is fixed to the handle 1 at a substantially vertical angle. FIGS. 2A to 2D show four conditions in which the handle 1 and the head 2 are hindered by an obstacle 100 in use.

SUMMARY OF THE INVENTION

It is therefore a main object of this invention to provide a hammer having a head which can be rotated and positioned with respect to the handle of the hammer to prevent the handle and/or head of the hammer from being hindered by an obstacle in operation.

Accordingly, the hammer of this invention includes a handle having a pivoting head connected to one end thereof and a means for positioning the head at an angle with respect to the handle. The head of the hammer can be rotated to a proper position and positioned so as to avoid the obstacle on the operation way.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
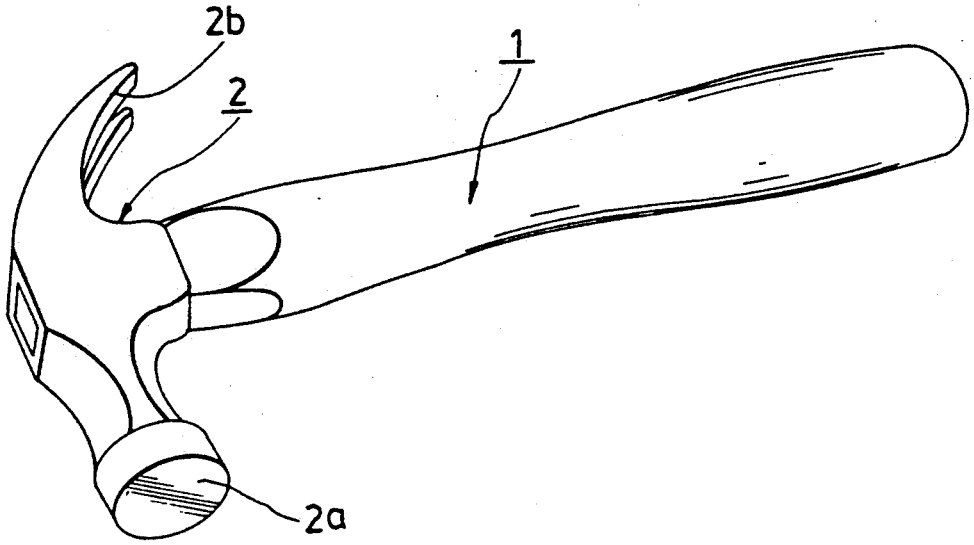
FIG.1 PRIOR ART
FIG. 1 is a perspective view of a conventional hammer.
Figure 2A:
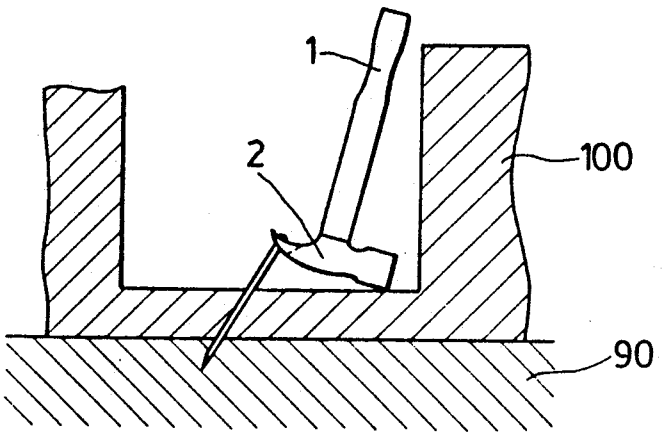
FIG.2A PRIOR ART
FIGS. 2A to 2D are schematic views of the conventional hammer in different operation positions.
Figure 2B:
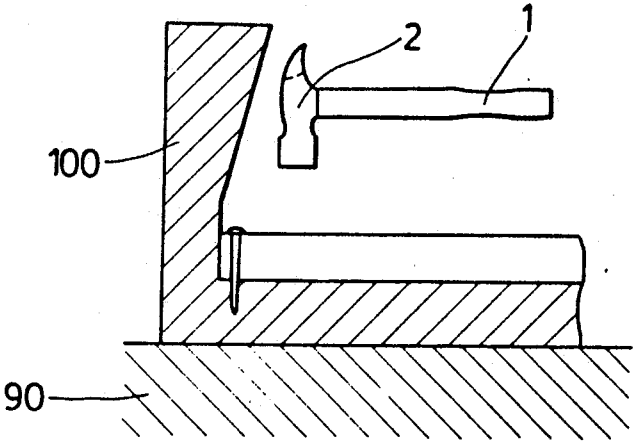
FIG.2B PRIOR ART
Figure 2C:
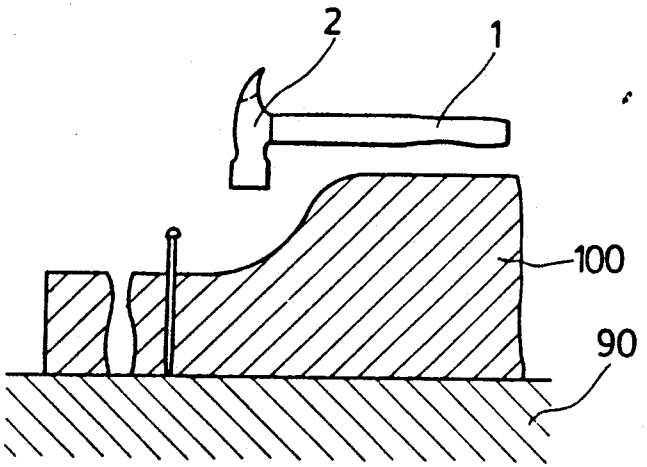
FIG.2C PRIOR ART
Figure 2D:
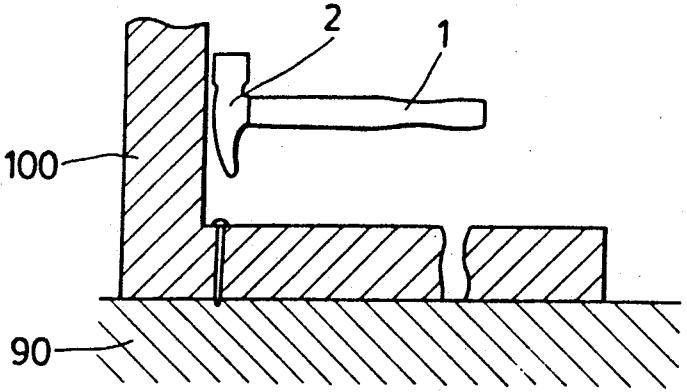
FIG.2D PRIOR ART
Figure 3:
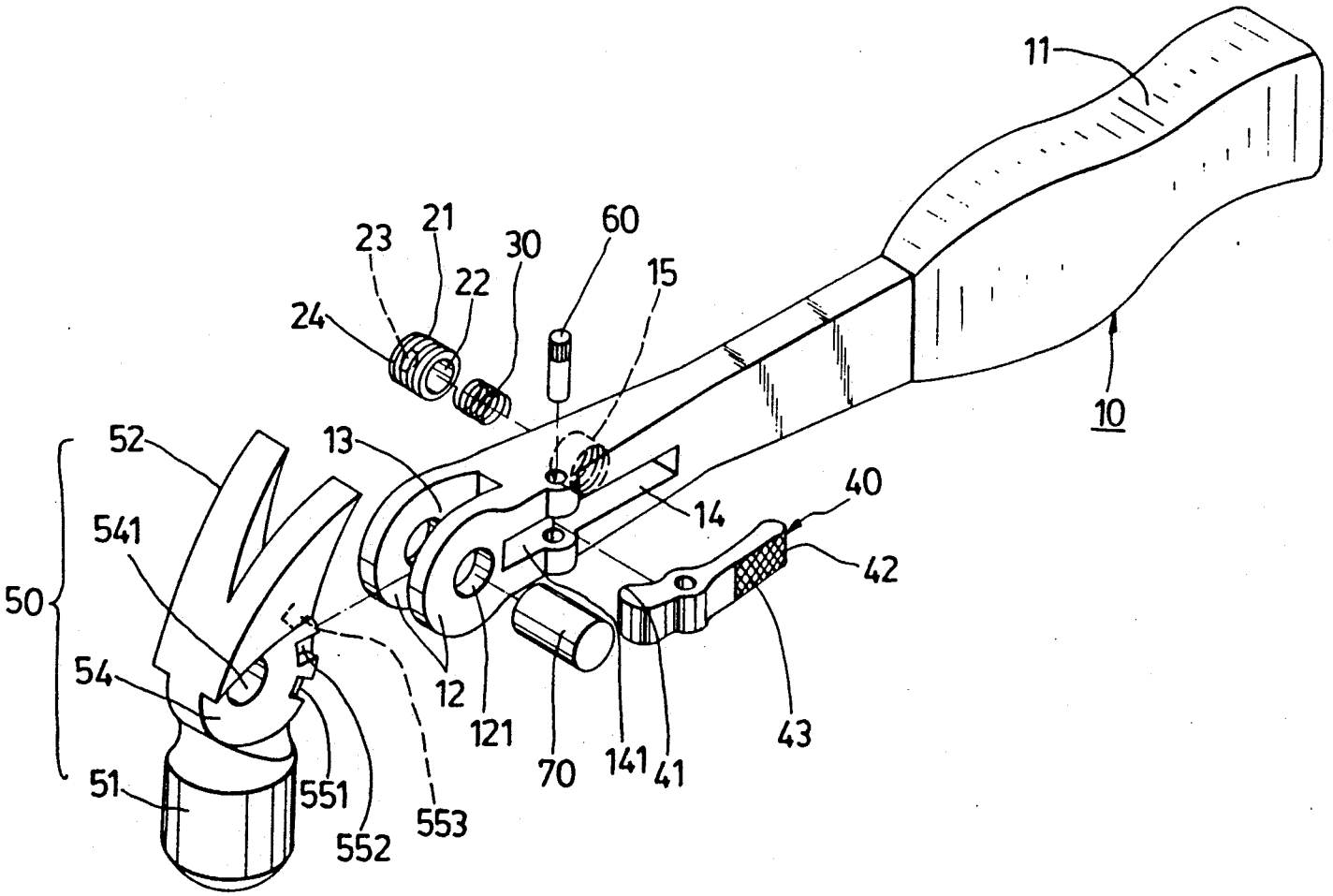
FIG. 3 is a perspective exploded view of a preferred embodiment of a hammer of this invention.
Figure 4:
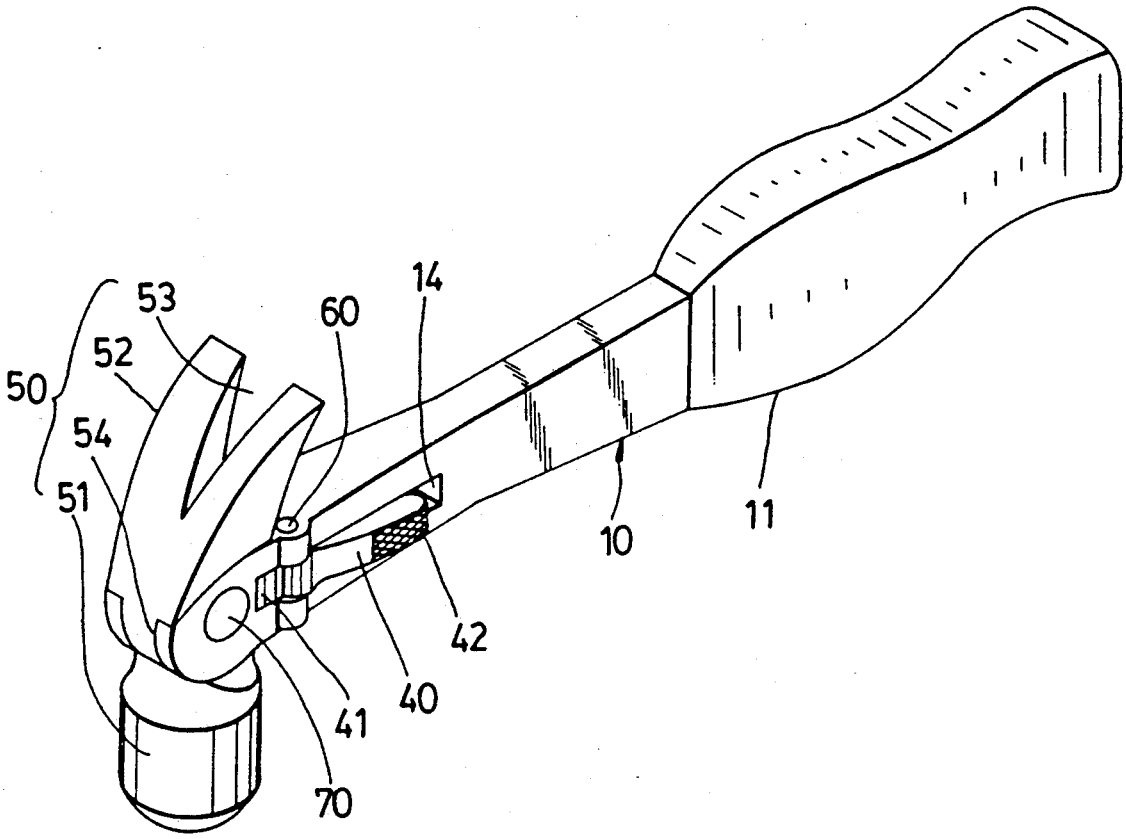
FIG. 4 is a perspective view of the preferred embodiment of the hammer of this invention.

Referring to FIGS. 3 and 4, a preferred embodiment of a hammer of this invention includes a handle 10 having a grip 11 and a head 50 pivotally connected to the handle 10.

One end of the handle 10, which is opposite to the grip 11, has two projections 12 longitudinally extending therefrom. A receiving portion 13 is formed between the two projections 12. Each of the projections 12 has a pivot hole 121 formed therein. The handle 10 has a longitudinal groove 14 adjacent to one of the projections 12. The groove 14 has a communication portion 141 communicating with the receiving portion 13 of the handle 10. A lever arm 40 is pivotally mounted in the longitudinal groove 14 by a pin member 60. The lever arm 40 has a first end 41 and a second end 42. A rough face 43 is formed adjacent to the second end 42 of the lever arm 40. The first end 41 of the lever arm 40 extends near the communication portion 141 into the receiving portion 13 of the handle 10 when the second end 42 of the lever arm 40 is rotated outwardly from the longitudinal groove 14. A transverse threaded bore 15 extends from the external surface of the handle 10 to the longitudinal groove 14 near the second end 42 of the lever arm 40. A hollow threaded rod 21 has a close end 24 with an hexagonal adjusting hole 23 and an open end 22 in which a coiled spring 30 is received. The coiled spring 30 urges the second end 42 of the lever arm 40 to move away from the longitudinal groove 14. However, if desired, the open end 22 of the hollow threaded rod 21 may be used to push the second end 42 of the lever arm 40 to move away from the longitudinal groove 14.

The head 50 of the hammer includes a bell 51, a claw 52 and an intermediate portion 54. A through hole 541 is formed in the intermediate portion 54. The intermediate portion 54 is adapted to be received in the receiving portion 13 of the handle 10. A pivot pin 70 passes through the pivot holes 121 of the two projections 12 and the through hole 541 of the head 50, so that the head 50 can be rotated with respect to the handle 10. The intermediate portion 54 of the head 50 has three recesses 551, 552, 553 formed in the periphery thereof one of which engages the first end 41 of the lever arm 40 to position the head 50 of the hammer at an angle with respect to the handle.

Figure 5:
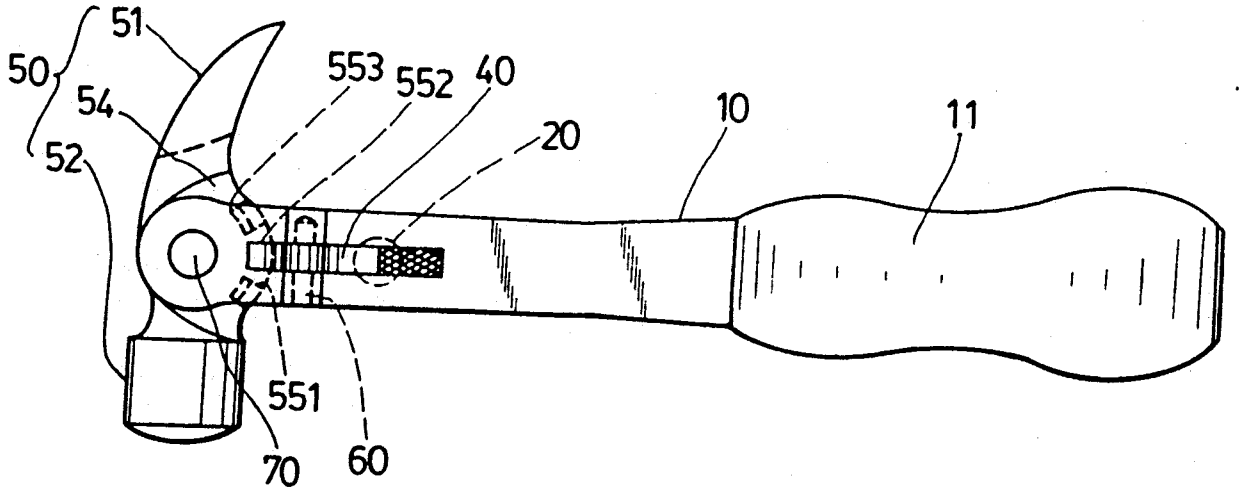
FIG. 5 is a partially sectional side view of the hammer of FIG. 4.
Figure 6A:
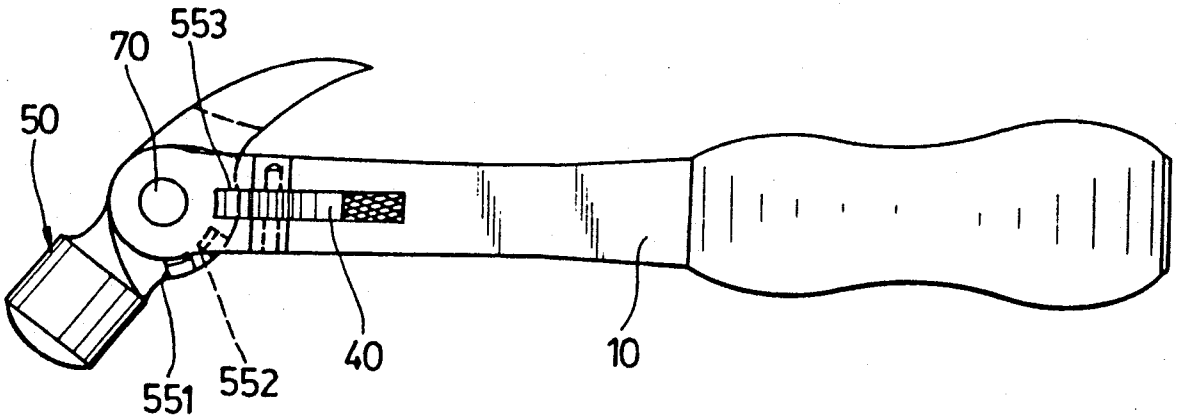
FIG. 6A is a partially sectional side view of the hammer of FIG. 4 in which the head of the hammer is rotated to a first position with respect to the handle of the hammer.
Figure 6B:
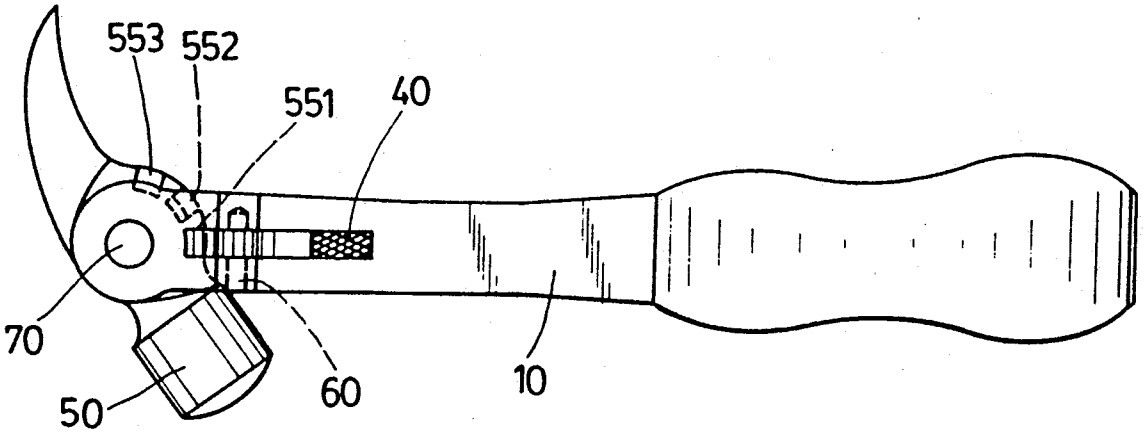
FIG. 6B is a partially sectional side view of the hammer of FIG. 4 in which the head of the hammer is rotated to a second position with respect to the handle of the hammer.
Figure 7B:
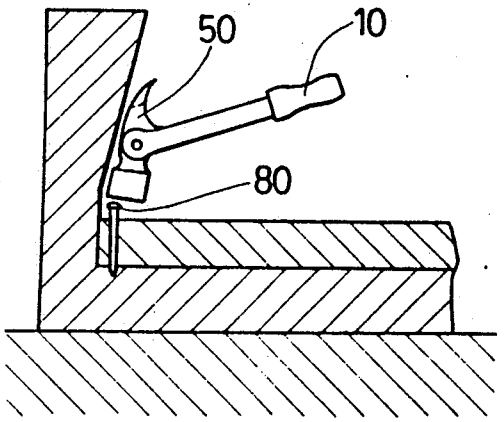
FIGS. 7A to 7D are schematic views showing the hammer of this invention in different operation positions.
Figure 7D:
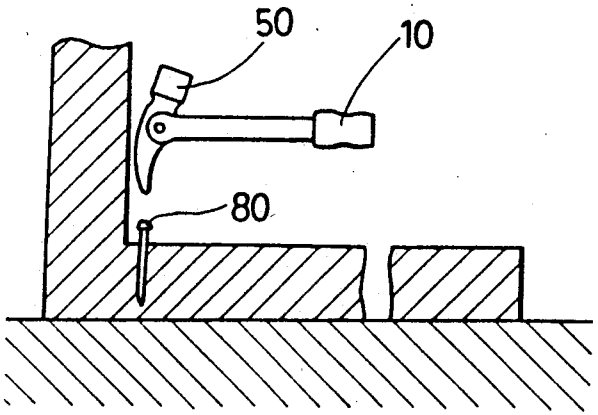
Figure 7A:
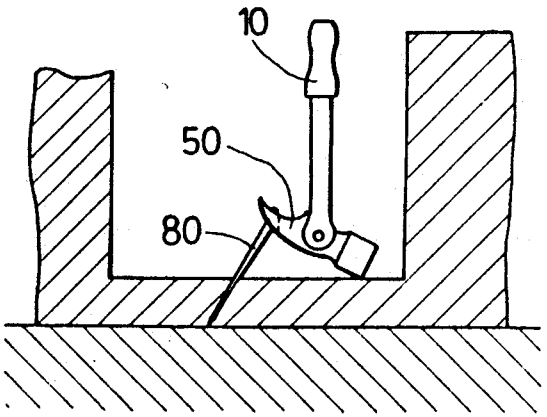
Figure 7C:
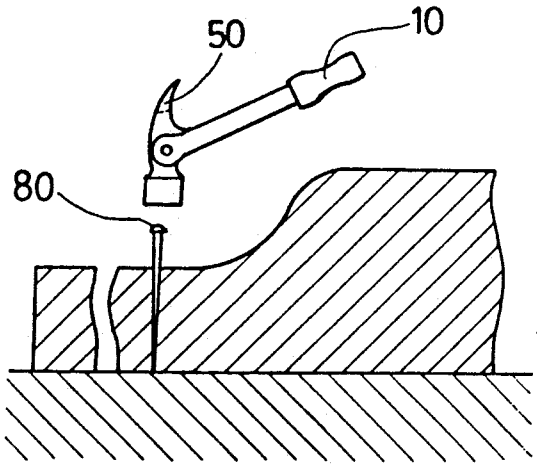
Figure 8:
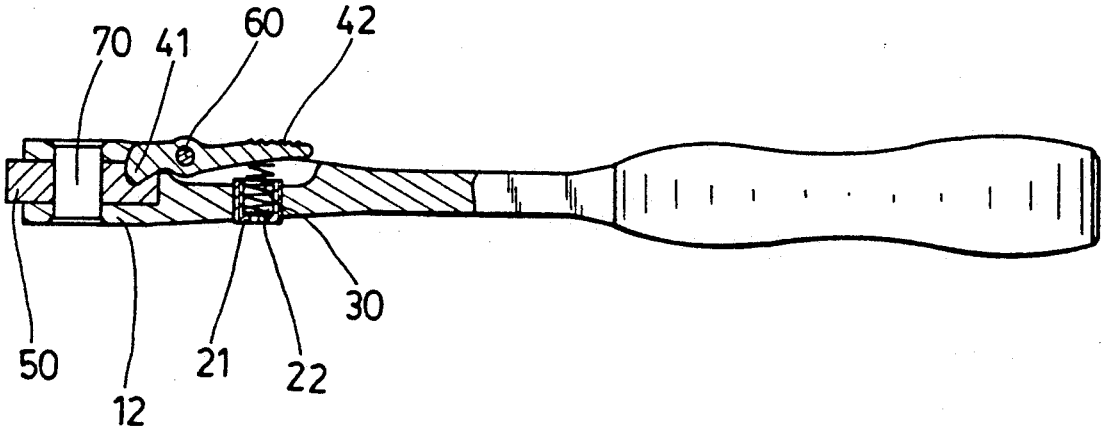
FIG. 8 is a partially sectional bottom view of the hammer of this invention.

FIGS. 5, 6A and 6B illustrate the first end 41 of the lever arm 40 engaged with the recesses 552, 553 and 551 of the head 50. The first end 41 of the lever arm 40 can be changed from one position to another by depressing the second end 42 of the lever arm 40 to disengage from one of the recesses 551, 552 and 553 and rotating the head 50, then allowing the first end 41 to engage another recess by the biasing force of the coiled spring 30 exerting on the second of the lever arm 40, as best illustrated in FIG. 8. Thereby, in use, the head 50 can be adjusted to different angles with respect to the handle 10 of the hammer of this invention as desired.

FIGS. 7A to 7D show the hammer of this invention pulling or striking a nail 80 without being hindered by an obstacle around the nail 80.

With this invention thus explained, it is apparent that numerous modifications and variations can be made without departing from the scope and spirit of this invention. It is therefore intended that this invention be limited only as indicated in the appended claims.

I claim:

1. A hammer comprising:

a handle having two projections longitudinally extending from one end of said handle, a receiving portion formed between said two projections, a longitudinal groove adjacent to one of said projections, and a communication port communicating between said longitudinal groove and said receiving portion;

a head pivotally mounted between said two projections of said handle on a first lateral axis of said handle, said head having an intermediate portion adapted to be received in said receiving portion of said handle and including a plurality of recesses located for alignment with said communication portion of said handle at select angles of said head relative to said handle;

a lever arm pivotally mounted in said longitudinal groove of said handle on a second lateral axis of said handle that is perpendicular to said first lateral axis of said handle, said lever arm having a first end and a second end, whereby said first end of said lever arm is adapted to extend through said communication portion of said handle and into said recesses of said head when said second end of said lever arm is rotated to move away from said longitudinal groove of said handle; and a spring member mounted in said longitudinal groove of said handle and engaging said second end of said lever arm, whereby said spring member forces said second end of said lever arm to move away from said longitudinal groove of said handle.

2. A hammer as claimed in claim 1, wherein said handle has a transverse threaded bore extending from an external surface of said handle to said longitudinal groove near said second end of said lever arm, and a hollow threaded rod having a close end and an open end, said spring member being a coiled spring received in said hollow threaded rod, said open end of said hollow threaded rod being capable of pushing said second end of said lever arm to move away from said longitudinal groove.

* * * * *